US008281948B2

(12) United States Patent
Stanek et al.

(10) Patent No.: US 8,281,948 B2
(45) Date of Patent: Oct. 9, 2012

(54) OVERPACK SALVAGE DRUM

(75) Inventors: Larry Stanek, Akron, OH (US); Timothy D. Reed, Solon, OH (US); Scott R. Janda, Solon, OH (US)

(73) Assignee: ENPAC, L.L.C., Eastlake, OH (US)

( * ) Notice: Subject to any disclaimer, the term of this patent is extended or adjusted under 35 U.S.C. 154(b) by 750 days.

(21) Appl. No.: 12/464,616

(22) Filed: May 12, 2009

(65) Prior Publication Data

US 2010/0288667 A1 Nov. 18, 2010

(51) Int. Cl.
*B65D 45/16* (2006.01)

(52) U.S. Cl. ..... 220/324; 206/326

(58) Field of Classification Search ..... 220/265, 220/324, 326, 285, 286, 270; 215/280
See application file for complete search history.

(56) References Cited

U.S. PATENT DOCUMENTS

| | | | | |
|---|---|---|---|---|
| 3,250,423 | A * | 5/1966 | Curran | 220/323 |
| 4,190,169 | A * | 2/1980 | Pehr | 215/252 |
| 4,401,227 | A * | 8/1983 | Pehr | 215/252 |
| 4,708,258 | A | 11/1987 | Shaw et al. | |
| 5,096,083 | A | 3/1992 | Shaw et al. | |
| 5,170,905 | A * | 12/1992 | Luch | 220/276 |
| 6,571,977 | B2 * | 6/2003 | Goncalez et al. | 220/506 |
| 7,703,618 | B2 * | 4/2010 | Derrien | 215/375 |
| 2006/0000793 | A1 * | 1/2006 | Mavin et al. | 215/253 |
| 2007/0295632 | A1 | 12/2007 | Palisin | |

* cited by examiner

*Primary Examiner* — David Fidei
(74) *Attorney, Agent, or Firm* — Rankin, Hill & Clark LLP

(57) ABSTRACT

An overpack salvage drum including a drum body for holding a package to be overpacked, a lid adapted to be rotatably threaded onto the drum body to seal the package held in the drum body therein, and a clip adapted to be operatively associated with the lid before the lid is rotatably threaded onto the drum body. The clip is adapted to break in preference to the lid and the drum body in the event that the initial integrity of the seal between the lid and the drum body is compromised.

10 Claims, 6 Drawing Sheets

OVERPACK SALVAGE DRUM

BACKGROUND OF INVENTION

1. Field of Invention

The present invention relates to an overpack salvage drum that includes a drum body for containing a package and a lid for sealing the package within the drum body. More particularly, the present invention relates to an overpack salvage drum that includes a clip for indicating whether the seal between the drum body and the lid has been compromised.

2. Description of Related Art

The U.S. Department of Transportation ("USDOT") has established regulations for removable head salvage drums (see, e.g., 49 C.F.R. §1.173(c)), which are also known in the art and hereinafter referred to herein as overpack salvage drums. Overpack salvage drums are used in a variety of applications, including for the containment of packages that have been damaged, have otherwise become defective or have been found to be leaking and/or for the containment of potentially hazardous solid materials while they are being transported. Shaw et al., U.S. Pat. No. 4,708,258, discloses a rotationally molded polyethylene overpack salvage drum that meets such USDOT standards.

The overpack salvage drum according to Shaw et al. includes a single-walled drum body having an open end and a double-walled lid that is adapted to threadingly engage the open end of the drum body and thereby seal and contain a steel drum therein. A closed-cell foam gasket in the lid seals the closure between the lid and the drum body. One of the features of the overpack salvage drum according to Shaw et al. is that the lid can be selectively threaded onto and removed from the drum body. However, there are some applications in which it would be highly desirable to be able to readily determine whether the seal between the lid and the drum body has been compromised. This is not possible with the overpack drum according to Shaw et al.

BRIEF SUMMARY OF THE INVENTION

In view of the foregoing, the present invention is directed toward an overpack salvage drum that includes a frangible clip that is operatively associated with the lid and engages with one or more structures protruding from the drum body when the lid is sealingly engaged with the drum body. Subsequent removal of the lid from the drum body causes the clip to fracture thereby making it evident that the integrity of the original seal has been compromised.

In a preferred embodiment of the invention, the lid is adapted to threadingly engage the open end of the drum body and thereby seal and contain a package therein. In such embodiment, the frangible clip is adapted to be connected to the lid before the lid is threaded onto the open end of the drum body. The frangible clip includes a tail portion that extends below an annular skirt portion of the lid when the clip is connected to the lid. An outer portion of an intermediate side wall portion of the drum body is provided with a plurality of projections. At least one of the plurality of projections includes a camming surface for contacting and lifting the tail portion of the clip over the projection when the lid is threaded onto the drum body. The projection also includes a non-camming blocking surface that is adapted to contact the tail portion of the clip and thereby prohibit the lid from being unthreaded from the drum body. Preferably, when the lid and clip assembly is threaded onto the drum body, the tail portion of the clip cams sequentially over and past a plurality of projections until the lid reaches a predetermined point wherein the lid is optimally aligned on the drum body, thereby substantially permanently overpacking the package placed therein. Once the lid is secured to the drum body with the tail portion of the clip retained against the non-camming blocking surface of the projection, the lid cannot be removed from the drum body without producing evident damage to the clip, the lid and/or the drum body. The clip is preferably made of a frangible plastic material, which will fracture when force is applied to it.

The foregoing and other features of the invention are hereinafter more fully described and particularly pointed out in the claims, the following description setting forth in detail certain illustrative embodiments of the invention, these being indicative, however, of but a few of the various ways in which the principles of the present invention may be employed.

DETAILED DESCRIPTION OF THE INVENTION

A preferred embodiment of an overpack salvage drum 10 according to the invention is shown in FIGS. 1-8. The overpack salvage drum 10 comprises a drum body 20, a lid 30 and at least one clip 40. The drum body 20 is adapted to receive and contain a package. The lid 30 is adapted to be secured to the drum body 20 to seal that package within the volume defined by the drum body 20 and the lid 30. And, the clip 40 is adapted to inhibit removal of the lid 30 from the drum body 20. Throughout the instant specification and in the appended claims, the term "package" thus refers to any solid material that may be contained within the overpack salvage drum 10 including, but not limited to, containers (e.g., metal drums or plastic drums etc.) that may contain liquids or solids or a combination of liquids and solids, solid manufactured parts (e.g., piping and fittings etc.) and other solid materials (e.g., contaminated soils etc.).

The drum body 20 and lid 30 are preferably formed of a durable, chemical resistant polymer such as, for example, linear low density polyethylene (LLDPE). However, it will be appreciated that other suitable polymers can be used, if desired. The drum body 20 and the lid 30 can be formed by rotational molding or other polymer molding process.

The clip 40 is preferably made of a frangible material. As used herein, the term "frangible" means that the material is more likely to fracture upon being exposed to force rather than it is to deform plastically and then regain its original appearance after the force is removed. Preferably, the frangible material is a polymer, but one that is more brittle than the polymer used to form the drum body 20 and the lid 30. High density polyethylene (HDPE) can be used, for example. The clip 40 is preferably formed by injection molding or other plastic molding process.

Figure 1:
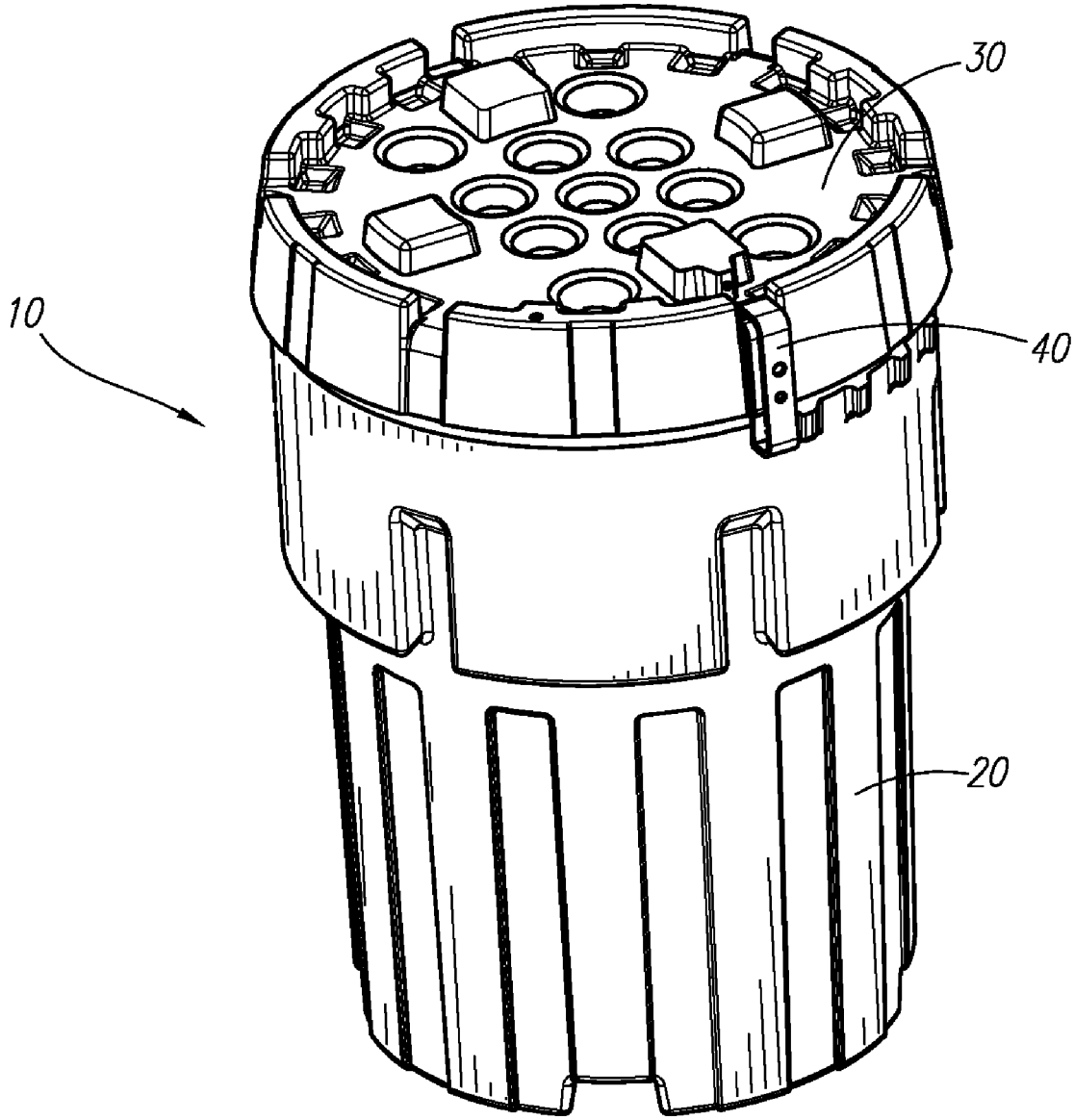
FIG. 1 is a perspective view of a preferred embodiment of an overpack salvage drum according to the invention.
Figure 2:
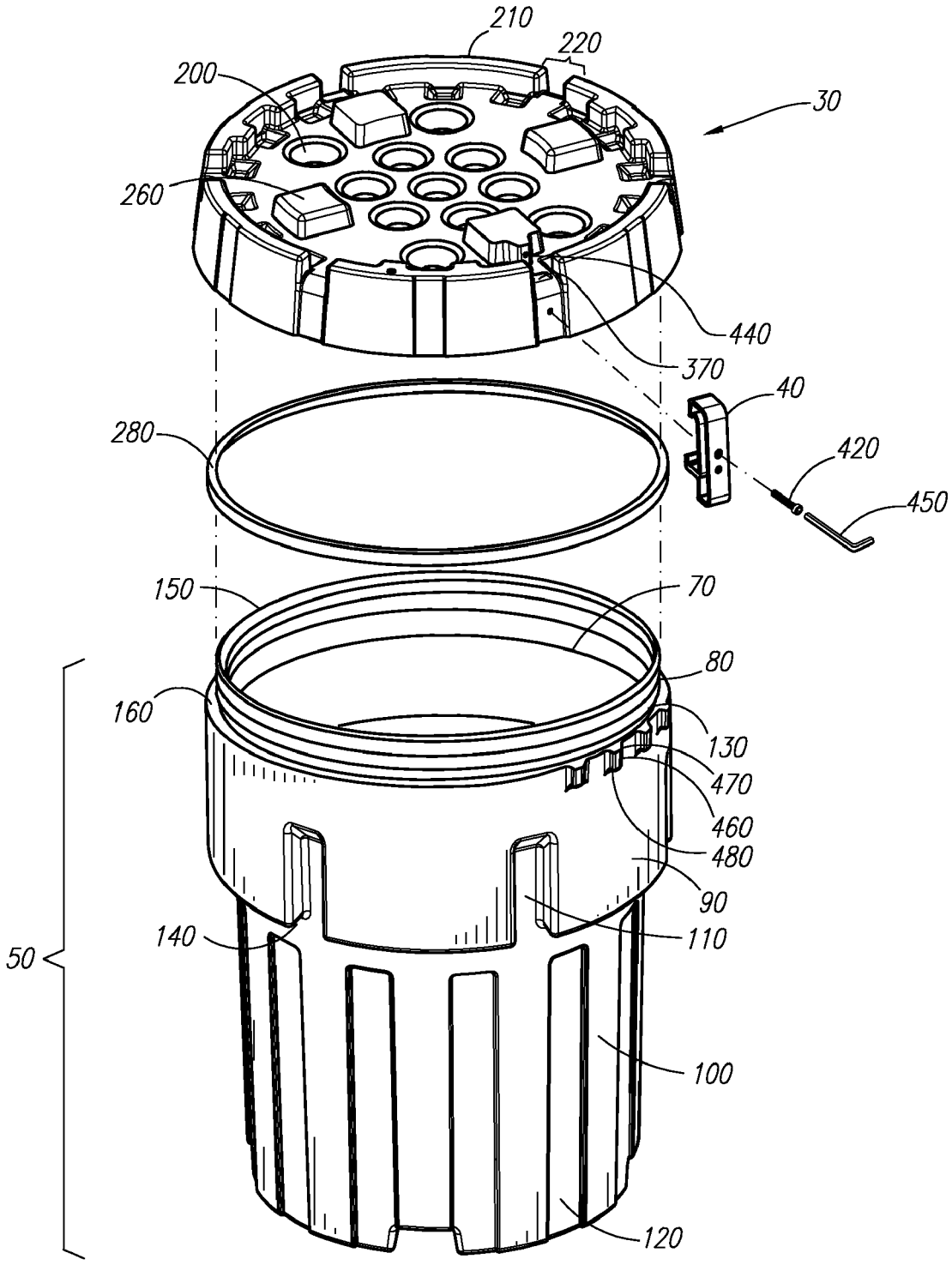
FIG. 2 is an exploded perspective view of the overpack salvage drum shown in FIG. 1.
Figure 3:
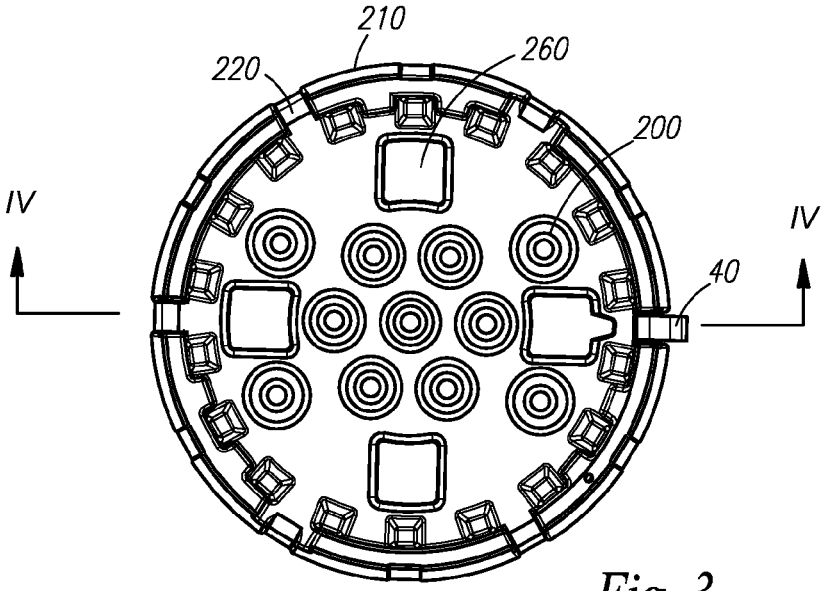
FIG. 3 is a top plan view of the overpack salvage drum shown in FIG. 1.
Figure 4:
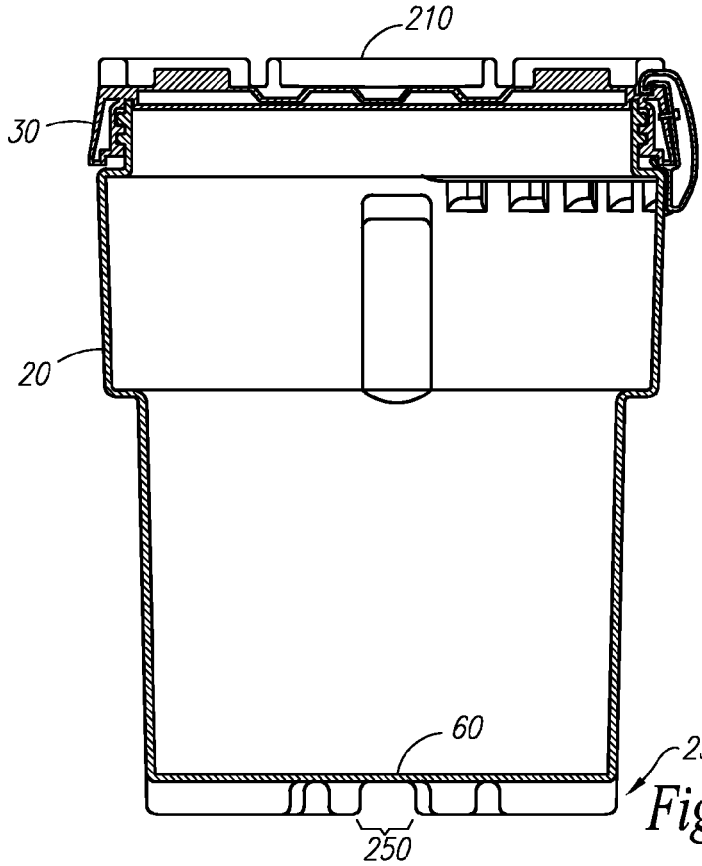
FIG. 4 is a side section view of the overpack salvage drum taken along the line IV-IV in FIG. 3.

With particular reference to FIG. 2, the drum body 20 is preferably a single-walled structure that comprises a solid, side wall 50 that tapers outwardly from a bottom wall 60 and an open end 70. The bottom wall 60, which is discussed in greater detail below, and the side wall 50 are preferably substantially circular. The side wall 50 preferably comprises an upper side wall portion 80, an intermediate side wall portion 90 and a lower side wall portion 100. The intermediate side wall portion 90 is disposed between the upper side wall portion 80 and the lower side wall portion 100 and has a diameter that is greater than the diameter of both the upper side wall portion 80 and the lower side wall portion 100.

A plurality of substantially vertical intermediate side wall recesses 110 are preferably formed in the intermediate side wall portion 90. The intermediate side wall recesses 110 strengthen the intermediate side wall portion 90 of the drum body 20. The intermediate side wall recesses 110 preferably do not extend the full height of the intermediate side wall portion 90, which allows the drum body 20 to flex during impact.

A plurality of substantially vertical lower side wall recesses 120 are also preferably formed in the lower side wall portion 100. The lower side wall recesses 120 strengthen the lower side wall portion 100 of the drum body 20. Like the intermediate side wall recesses 110, the lower side wall recesses 120 also preferably do not extend the full height of the lower side wall portion 100 in which they are disposed, which allows the drum body 20 to flex during impact.

At least one thread 130 is provided on an exterior circumferential surface of the upper side wall portion 80. Two or more threads 130 can be used, if desired. It will be appreciated that the depth, pitch and width of the threads will be determined in view of the size of the overpack salvage drum 10. Preferably, the threads 130 allow the lid 30 to rotate 720° from a starting position to a fully seated position.

The inside diameter of the upper side wall portion 80 of drum body 20 is preferably greater than the outer diameter of the lower side wall portion 100 of the drum body 20. Thus, the lower side wall portion 100 of a first drum body 20 may be received within the upper side wall portion 80 of a second drum body 20. This allows several empty drum bodies 20 to be nested together, one inside the other, in a stacked arrangement, which minimizes shipping space and storage space prior to use.

A lower annular shoulder 140 is formed on drum body 20 between the intermediate side wall portion 90 and the lower side wall portion 100. The lower annular shoulder 140 preferably defines a hemispherical or conical surface that serves as a self-centering annular groove for the upper edge 150 of a drum body 20 when two or more drum bodies 20 are nested together in a stack prior to use. The lower annular shoulder 140 can be used to lift the drum body 20 or a filled overpack salvage drum 10 (e.g., via the use of the forks of a lift truck).

The vertical recesses 110, 120 prevent the formation of a vacuum and thus make it easier to separate the top-most drum body 20 from a stack of drum bodies 20. An upper annular shoulder 160 is also formed on the drum body 20 between the intermediate side wall portion 90 and the upper side wall portion 80.

With reference to the accompanying figures, the lid 30 is preferably a double-walled structure. An annular skirt 170 (see FIG. 9B) extends downwardly from the perimeter of a substantially horizontal, circular double-walled body 180 of the lid 30. At least one recessed thread 190 (i.e., a groove) is formed on an inside circumferential surface of the annular skirt portion 170. The recessed thread 190 is adapted to threadingly engage (i.e., receive) the at least one raised thread 130 formed on the exterior circumferential surface of the upper side wall portion 80 of the drum body 20. The use of at least one raised thread 130 on the drum body 20 and at least one recessed thread 190 on the lid 30 is preferred because in the event that pressure were to build up within the drum body 20, such a thread configuration would tend to tighten the connection between the lid 30 and the drum body 20. But the opposite arrangement could be used, if desired. It will be appreciated that the number, pitch, depth and width of recessed threads 190 will correspond to the number, pitch, depth and width of the raised thread 130.

Preferably, the double-walled body 180 of the lid 30 is provided with a plurality of "kiss off" portions 200, which can be formed in any desirable shape or pattern. The "kiss off" portions 200 are preferably arranged across the lid to improve the strength of the lid 30. The "kiss off" portions 200 are formed where the two spaced-apart walls of the double-walled body 180 are brought together to form a single wall at discrete locations on the lid 30. "Kiss off" portions 200 provide additional rigidity for the double-walled body 180 of lid 30. It will be appreciated that the number and location of "kiss off" portions 200 will be dependent upon the dimensions of the overpack salvage drum 10, which is dependent upon the dimensions of the package to be overpacked.

The lid 30 is preferably provided with a plurality of castellations 210, which project upwardly from the perimeter of the double-walled body 180 of the lid 30. The castellations 210 are preferably arranged in a spaced relation around the perimeter of the lid 30. Gaps 220 between the castellations 210 are preferably sized to accommodate a beam, such as a wood 2"×4". Thus, an end portion of the beam can be received within a pair of gaps 220 aligned across a central axis of the lid 30, leaving the remainder of the beam available for use as a lever to assist with threading the lid 30 onto the drum body 20. It will be appreciated that the gaps 220 between the castellations 210 could be the same width (as illustrated) or could be of two or more two different widths such that at least a first pair of gaps 220 aligned across the central axis of the lid 30 will accommodate the wide dimension of a wood "2×4" (this dimension is typically about 3.5") and at least a second pair of gaps 220 aligned across the central axis of the lid 30 will accommodate the narrow dimension of a standard "2×4" (this dimension is typically about 1.5").

To facilitate stacking of two or more sealed overpack salvage drums 10, the castellations 210 and double-walled body 180 preferably define a recessed circular cavity for receiving the bottom end 230 of the drum body 20. By reason of the double walled body 180 and "kiss-off" portions 200, the lid 30 is sufficiently strong enough to accommodate a plurality of sealed, filled overpack salvage drums 10 stacked one on top of the other.

If desired, a plurality of kiss-off portions 240, which are shallower in depth than the kiss-off portions 200 provided in the double-walled body 180 of lid 30, can be formed proximal to or within the gaps 220 between castellations 210 in order to provide additional strength in the area of the gaps 220 and castellations 210.

In some instances, particularly when the package to be overpacked is not entirely full and/or when the package to be overpacked contains a lightweight material, the drum body 20 will have a tendency to rotate or spin on the floor or pavement as the lid 30 is being threaded thereon. To prevent the drum body 20 from rotating while the lid 30 is being threaded thereon, the circular bottom wall 60 of the drum body 20 can be provided with one or more channels 250, which cross the central axis of the circular bottom wall 60 of the drum body 20. The channels 250 are preferably sized such that they can receive a beam such as a wooden "2×4". A single channel 250, or more preferably a plurality of channels 250, are provided in the bottom wall 60. An installer can stand on a beam received within a channel 250 to prevent the drum body 20 from rotating when the lid 30 is being threaded onto the drum body. Alternatively, the beam can be fixed to the floor. The drum body 20 can be placed onto the beam such that the beam is received in one of the channels 250. The package to be overpacked can be placed into the drum body 20, either before or after the drum body has been placed onto the beam. Once the lid 30 has been secured to the drum body 20, the beam can be pulled from beneath the overpack salvage drum 10, or the overpack salvage drum 10 can be pushed off the beam.

The top side of the lid 30 is preferably provided with a plurality of blocks 260, which are adapted to be received within the channels 250 formed in the bottom wall 60 of the drum body 20 when two or more overpack salvage drums 10 are stacked one atop another. The blocks 260 help maintain the alignment of the stacked overpack salvage drums 10 when stacked.

Figure 5:
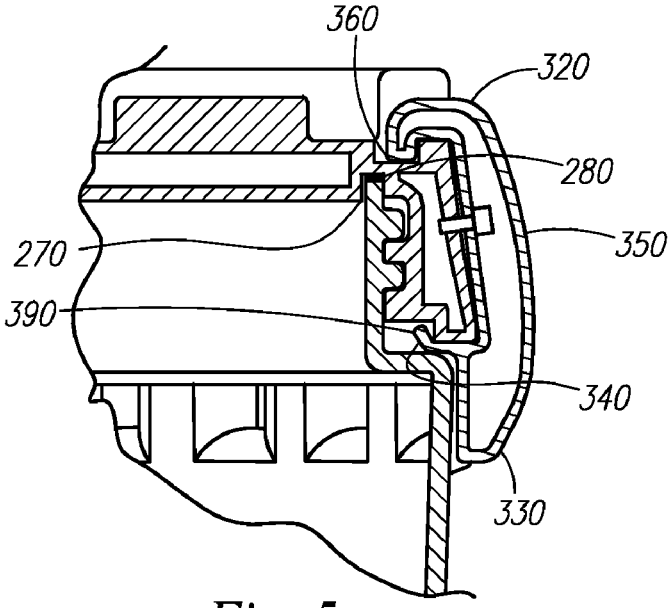
FIG. 5 is an enlarged portion of the section view shown in FIG. 4.

With reference to FIG. 5, an annular groove 270 is formed on the underside of the double-walled body 180 of the lid 30. The annular groove 270 extends completely around the lid 30 adjacent to the perimeter thereof. The annular groove 270 is adapted to receive a gasket 280, which may be received within the annular groove 270 before the lid 30 is engaged with the drum body 20. The gasket 280 is adapted to be sealingly compressed between the upper edge 150 of upper side wall portion 80 of the drum body when the raised thread 130 of the drum body 20 is mated with recessed thread 190 of lid 30.

Figure 9A:
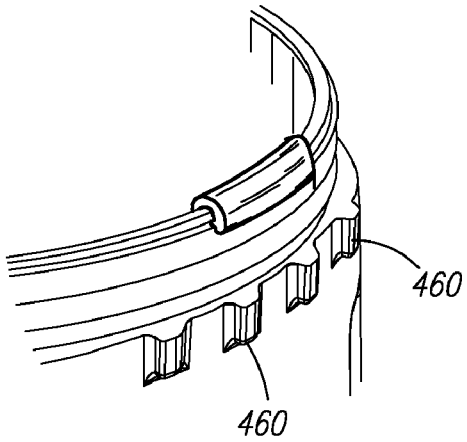
FIGS. 9A, 9B and 9C show a partial perspective view, a section view and an enlarged section view, respectively, of an alternative gasket arrangement for an overpack salvage drum according to the invention.
Figure 9B:
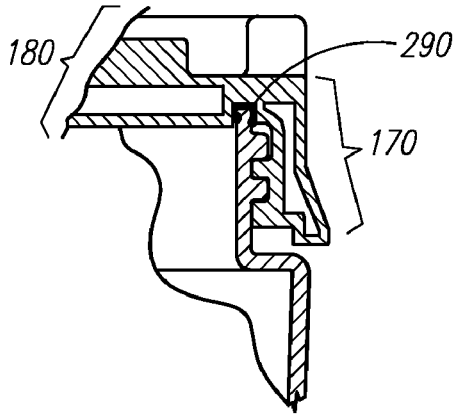
Figure 9C:
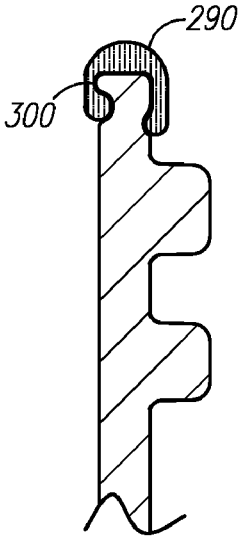

FIGS. 9A-9C show an alternative sealing arrangement. Instead of a gasket 280 being placed into an annular groove 270 in the lid 30 before the lid 30 is secured to the drum body 20, a U-shaped gasket 290 can be secured to the upper edge 150 of the drum body 20 before the lid 30 is secured to the drum body 20 (Note: for ease of illustration only a portion of the U-shaped gasket 290 is shown in FIG. 9A; the U-shaped gasket 290 actually surrounds the entire upper edge 150 of the drum body 20). The upper edge 150 of the drum body 20 can be provided with a lateral edge 300, which helps retain the U-shaped gasket 290 to the upper edge 150 of the drum body 20. It will be appreciated that other sealing means, such as O-rings, for example, can be used in place of gaskets. It will also be appreciated that the gasket need no be U-shaped. Gaskets having a circular sectional profile, for example, can also be used.

The annular skirt 170 terminates in a circumferential bottom edge 310. When the lid 30 is completely threaded onto the drum body 20, the circumferential bottom edge 310 is disposed near the upper shoulder 160 of the drum body 20, but a gap or space remains therebetween. The annular skirt 170 has an outer diameter that is approximately equal to the outer diameter of intermediate side wall portion 90. If desired, the gap or space between the circumferential bottom edge 310 and the upper shoulder 160 can be filled with optional curved filler strips (not shown) to prevent a handler of the overpack salvage drum 10 from attempting to lift the overpack salvage drum 10 by the lid 30 or from inserting the fork of a fork-lift or other tool between lid 30 and drum body 20. As noted above, the overpack salvage drum 10 is adapted to be lifted from the lower annular shoulder 140 or the bottom wall 60.

As noted above, the overpack salvage drum 10 according to the invention further comprises at least one clip 40, which is adapted to be operatively associated with the lid 30 before the lid 30 is threaded onto the drum body 20. One clip 40 is typically sufficient, but two or more clips 40 can be used, if desired. The clip 40 is preferably made of a frangible material, so that it will break when sufficient force is applied to it.

With reference to FIGS. 2 and 5-7, the clip 40 preferably includes a head portion 320, a tail portion 330, a hook portion 340 and a body portion 350 that spans between the head portion 320 and the hook portion 340 and defines a channel for receiving a portion of the annular skirt 170 of the lid 30. The head portion 320 includes an upper tip end 360 that is adapted to reside in a top recess 370 (see FIG. 2) formed in the top side 380 of the lid 30. The hook portion 340 includes a lower tip end 390 that is adapted to reside in a bottom recess 400 (see FIG. 7) formed in an interior side of the annular skirt 170 of the lid adjacent to the bottom edge 310. Before the lid 30 is threaded onto the drum body 20, the annular skirt 170 of the lid 30 can be deformed slightly, allowing one to insert the lower tip end 390 of the hook portion 340 of the clip 40 into the bottom recess 400 and the upper tip end 360 of the clip 40 into the top recess 370 formed in the top side 380 of the lid 30. Attaching the clip 40 to the bottom recess 400 first makes it more difficult to remove the clip 40 after the lid 30 has been secured to the drum body 20. Once the clip 40 has been operatively associated with the lid 30 in this manner to form a lid 30 and clip 40 assembly, the annular skirt 170 springs back into shape and holds the clip 40 securely in place. Preferably, the portion of the annular skirt 170 of the lid 30 received in the channel defined by the body portion 350 between the head portion 320 and the hook portion 340 is recessed slightly such that the sides 410 of the recessed area can provide lateral support for the clip 40 as the lid 30 is threaded onto the drum body 20.

A threaded fastener 420 such as, for example, a security hex socket pin-head screw or a TORX® brand-type security pin-head screw, is also preferably employed to ensure that the clip 40 remains securely associated with the annular skirt 170 of the lid 30 during use. A first threaded insert 430 can be provided in the recessed area within the lid 30 for receiving the threaded portion of the fastener 420. The first threaded insert 430 can be a molded-in insert, a self-tapping insert, an ultrasonically or thermally welded-in insert or the like. The fastener 420 is preferably used to secure the clip 40 to the lid 30 after the lid 30 has been threaded onto the drum body 20.

Figure 6:
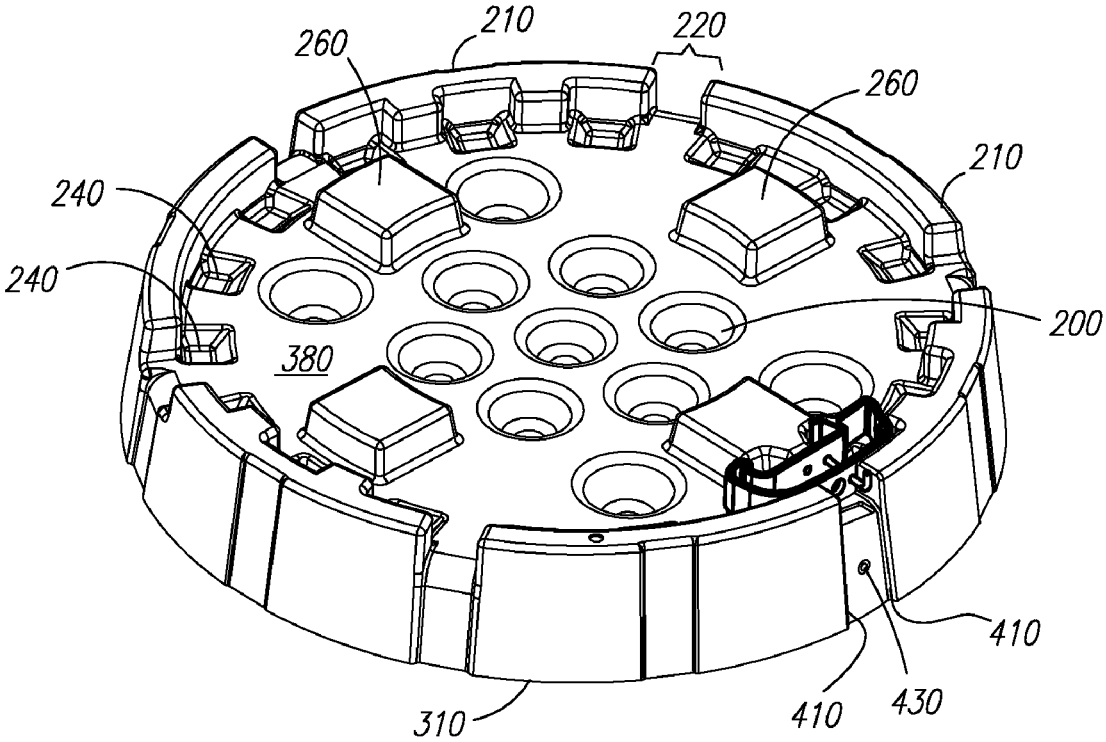
FIG. 6 is perspective view of the lid of the overpack salvage drum shown in FIG. 1 with the clip retained in a pre-use condition.
Figure 7:
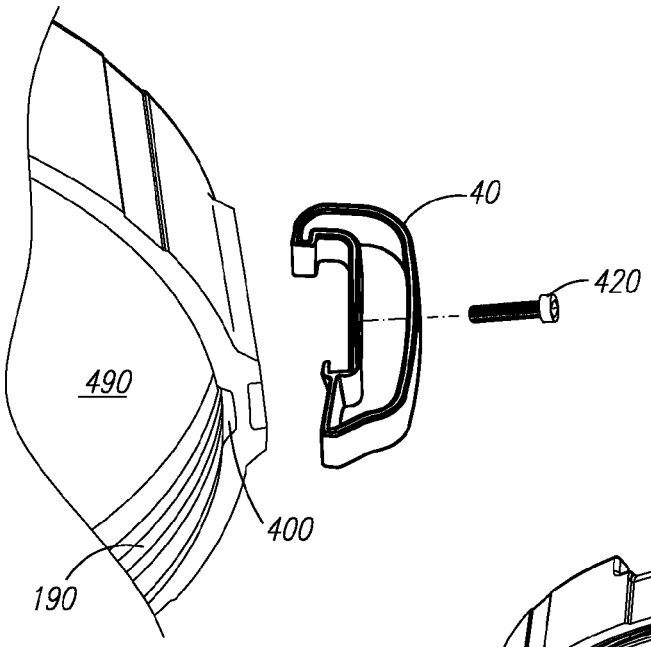
FIG. 7 is an exploded perspective view of a portion of a bottom side of the lid of the overpack salvage drum shown in FIG. 6.
Figure 8:
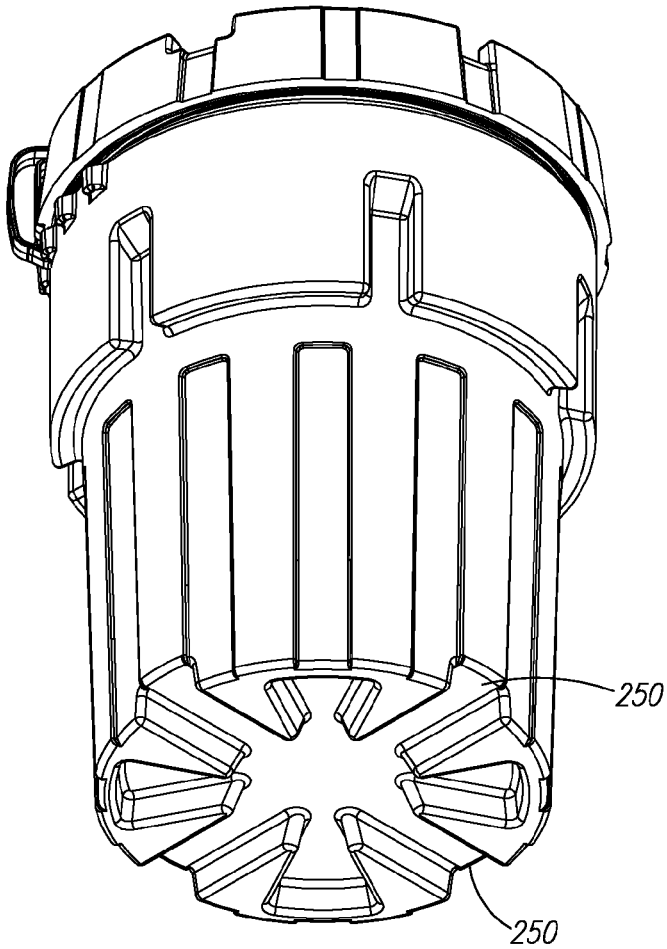
FIG. 8 is a perspective view of the overpack salvage drum shown in FIG. 1 showing the bottom side thereof.

With reference to FIG. 6, the clip 40 is preferably secured to one of the blocks 260 in the lid 30 before the overpack salvage drum 10 is prepared for use. The clip 40 can be secured to the lid 30 using the same fastener 420 that is later threaded into the first insert 430 to secure the clip 40 to the annular skirt 170 of the lid 30. A second threaded insert 440 can be mounted in the block 260 for receiving the threads of the fastener 420. Furthermore, a fastener driver 450, such as an Allen-wrench or other driver, can be operatively associated with the clip 40 (e.g., friction-fitted into holes in the clip) for removing and driving the fastener 420. Thus, the clip 40 can be secured to the lid 30 during shipping and storage prior to use, but can easily be removed from the lid 30 using the fastener driver 450 and reattached to the annular skirt portion 170 of the lid 30 to ready the lid 30 for use. It will be appreciated that the fastener driver 450 need not be retained with the clip 40 during shipping and storage (e.g., it could be a separate item included in a package containing printed operating instructions).

An outer portion of the intermediate side wall portion 90 of the drum body 20 is provided with a plurality of projections 460 proximal to the upper shoulder 160. The plurality of projections 460 are preferably formed only on a portion of the circumference of the drum body 20, as illustrated. At least one, and preferably all, of the plurality of projections 460 includes a camming surface 470, which is adapted to contact and gently lift the tail portion 330 of the clip 40 over the projection 460 as the lid 30 is threaded onto the drum body 20 without fracturing the clip 40. The camming surface 470 preferably has a smooth, arcuate surface profile. At least one, and preferably all, of the plurality of projections 460 also include a blocking surface 480 for contacting the tail portion 330 of the clip 40 and thereby prohibiting the lid 30 from being unthreaded from the drum body 20 after it has first been secured to the drum body 20.

Preferably, as the lid 30 and clip 40 assembly is threaded onto the drum body 20, the tail portion 330 of the clip 40 passes (vertically) above the plurality of projections 460 during the first revolution of the lid 30 and then contacts the projections 460 as the lid 30 approaches the optimal point at which the gasket 280 is properly compressed between the upper edge 150 of the drum body 20 in the annular groove 270 in the lid 30. At that time, the tail portion 330 of the clip 40 sequentially contacts the camming surface 470 of a first of a plurality of projections 460, which lifts the tail portion 330 over the first of the plurality of projection 460. This lifting and camming-over process is repeated until the lid 30 reaches the point at which the gasket 280 is optimally compressed to create a seal between the lid 30 and the drum body 20. Indicia can be provided on the drum body 20 indicating the particular space or spaces between the plurality of projections 460 where the lid 30 is deemed to have been adequately secured to the drum body 20.

Once the lid 30 has been securely threaded onto the drum body 20, the package contained within the drum body 20 is substantially permanently overpacked in the overpack salvage drum 10. Throughout the instant specification and in the appended claims, the phrase "substantially permanent" means that the lid 30 cannot be removed from the drum body 20 without creating some evident damage to either the clip 40, the lid 30 and/or the drum body 20. In some instances, it may be desirable to establish a "substantially permanent" seal between the lid 30 and the drum body 20 for only a short period of time, such as when an overpacked package is being transported from one location to another.

Once the lid 30 has been secured onto the drum body 20 in the manner thus described, the tail portion 330 of the clip 40 is retained in close proximity to the outer surface of the intermediate side wall portion 90 of the drum body 20. The lid 30 cannot be unthreaded from the drum body 20 because the tail portion 330 of the clip 40 contacts against the blocking surface 480 of the last projection 460 the tail portion 330 cammed over when the lid 30 was initially threaded onto the drum body 20. The blocking surface 480 does not lift the tail portion 330 of the clip 40 over the projection 460, but rather it blocks the tail portion 330 of the lid 30 from rotating back past the projection 460. It is not possible to remove the clip 40 from the lid 30 when the lid 30 is secured to the drum body 20, because one would have to cant the tail portion 330 of the clip 40 inwardly and flex the annular skirt 170 in order to disengage the upper tip end 360 of the clip 40 from the top recess 370 formed in the lid 30. This cannot be done because the intermediate side wall portion 90 of the drum body 20 prohibits inward movement of the tail portion 330 and the threaded engagement between the lid 30 and the drum body 20 prevents flexing of the annular skirt portion 170. Thus, one must damage the lid 30, the clip 40 and/or the drum body 20 in order to remove the lid 30 from the drum body 20 once the lid has first been secured thereto, which makes it evident that the integrity of the overpack salvage drum 10 has been compromised.

As noted above, the clip 40 is preferably frangible, which means that it will preferentially fracture before damage occurs to the drum body 20 and/or the lid 30. The frangibility of the clip 40 also makes it less likely that the clip 40 will penetrate the overpack salvage drum 10 in the event the overpack salvage drum 10 falls over or an external impact force is directed at the clip 40.

The present invention also provides a method of overpacking a package using an overpack salvage drum 10 according to the invention. First, a package to be overpacked is placed into the drum body 20. This can be accomplished by lowering the package into an upright drum body 20, by placing the package onto the bottom side 490 of the lid 30 and then placing the drum body 20 upside down onto the lid 30, or more typically, by laying the drum body 20 onto its side and sliding the package therein and then standing the package-filled drum body 20 upright.

A clip 40 is operatively associated with the lid 30 as described above to form a lid 30 and clip 40 assembly before the lid 30 is engaged with the drum body 20. The lid 30 and clip 40 assembly is placed onto the drum body 20, thereby forming a container that contains the package to be overpacked. The lid 30 is rotated until the raised threads 130 and the recessed threads 190 are properly indexed and engage with each other causing the lid 30 to thread onto the drum body 20. As noted above, a beam can be placed into the gaps 220 between castellations 210 on the lid 30 and used as a lever to facilitate the threading of the lid 30 onto the drum body 20, if necessary. And, a beam can be disposed in the channel 250 in the drum body 20 to prevent the drum body 20 from rotating as the lid 30 is being threaded thereon, if necessary.

Before the lid 30 reaches the point at which it is optimally threaded onto the drum body 20, the tail portion 330 of the clip 40 contacts the camming surface 470 of a projection 460. The camming surface 470 of the projection 460 lifts the tail portion 330 of the clip 40 over the projection 460 without causing damage to the clip 40. The lid 30 is tightened onto drum body 20 until the upper edge 150 of the drum body 20 compresses the gasket 280 in the annular groove 270, thereby sealing the package within the overpack salvage drum 10. At this point, the tail portion 330 of the clip is preferably retained in a gap between projections 460, with the tail portion 330 abutting against the blocking surface 480 of the projection 460. This prohibits the lid 30 from inadvertently unthreading from the drum body 20. In order to remove the lid 30 from the drum body 20, it is necessary to visibly damage the clip 40, the lid 30 and/or the drum body 20. The damage to the clip 40, lid 30 and/or drum body 20 makes it readily evident that the initial integrity of the overpack salvage drum 10 has been compromised.

As noted above, one of the features of the invention is that it allows for the establishment of a substantially permanent, tamper-evident seal between a lid and a drum body of an overpack salvage drum. This can be further enhanced by providing unique identification numbers or codes on the lid, clip and/or drum body. Thus, even if a damaged clip is replaced with a new clip, it will be possible to determine that the initial integrity of the overpack salvage drum has compromised.

The lid and clip can also be shipped with an identification tag or label, which includes unique identifying indicia (e.g., serial numbers, bar codes etc.). The tag or label can be tucked beneath the clip when the clip is in the shipping position. The label or tag can be secured partially beneath the clip when the clip is operatively associated with the lid. The label or tag can include date fields that can be punched to indicate the date the package was sealed into the overpack salvage drum. Furthermore, the label or tag can identify the particular contents of the package.

It will be appreciated that the clip could be formed integrally with the lid. However, the inventors believe that this is a less desirable arrangement. When it becomes necessary to remove a lid from an overpack salvage drum according to the invention, it is preferable for the clip to be damaged, but not the lid and/or the drum body. A new clip with a new identification number or code can be installed when the lid is placed back onto the drum body. If an integral lid and clip is used, the entire lid and clip assembly must be replaced.

Figure 10:
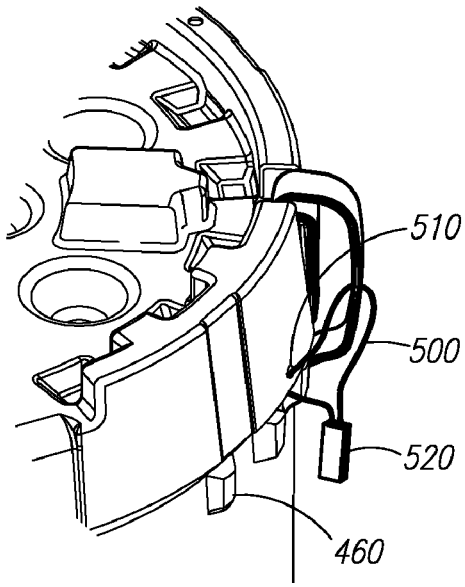
FIG. 10 is a partial perspective view of an optional tamper-evident feature of the invention.

It will be appreciated that additional structures can be provided to further enhance the substantially permanent, tamper-evident seal between the lid and the drum body. For example, as shown in FIG. 10, a cable 500 can be drawn through the clip 40 and one or more eyelets 510 permanently associated with either the lid 30 and/or the drum body 20. The eyelet(s) 510 can be permanently associated with the lid 30 and/or the drum body 20 using molded-in inserts, self-tapping inserts and/or by spin-welding techniques. A lock 520, such as are commonly used to ensure that the initial integrity of the seal on utility meters, can be secured to the cable 500. Furthermore, the fastener 420 can be provided with an opening through which the cable 500 can pass. Once the cable 500 is threaded through the opening in the fastener 420, it is impossible to remove the fastener 420 without cutting the cable 500.

Preferably, the clip is provided in a color that is highly visible, yet contrasts with the color of the lid and drum body. For example, the lid and drum body could be formed of bright yellow polymer, with the clip being red. This allows for quick visual inspection to confirm that the clip has been properly installed onto and remains properly installed onto the overpack salvage drum. In one embodiment, a different color-coded clip is used to readily indicate the type of material contained within the overpack salvage drum.

In another preferred embodiment of the invention, the overpack salvage drum 10 according to the invention further comprises an identification tag, which can be secured to the overpack salvage drum 10 using the fastener 420 that secures the clip 40 to the lid 30 after the lid 30 has been threaded onto the drum body 20. The fastener 420 passes through an opening formed in the identification tag to keep the identification tag secured to the overpack salvage drum 10 until the fastener 420 is removed. The identification tag, fastener 420, clip 40, fastener driver 450 and any other material (e.g., instructions, warranty etc.) can be stored within a bag or pouch prior to use.

The identification tag can include pre-printed information, which can be punched by an end-user as appropriate to provide information such as, for example, the composition of the package contained within the overpack salvage drum 10, the date the package was contained within the overpack salvage drum 10 and/or the origin or location of the package contained within the overpack salvage drum 10. Alternatively, indicia can be added to the identification tag to provide such information. The indicia can be handwritten, machine written (e.g. bar codes) or can be electronic in nature (e.g., an RF tag). Preferably, the identification tag is made of a durable, chemical resistant material such as a plastic film or a plastic-fiber textile material (e.g., DuPont's TYVEK® non-woven).

Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept as defined by the appended claims and their equivalents.

What is claimed is:

1. An overpack salvage drum comprising:

a drum body for holding a package to be overpacked;

a lid adapted to be rotatably threaded onto the drum body to seal the package held in the drum body therein; and a clip adapted to be operatively associated with the lid before the lid is rotatably threaded onto the drum body, wherein the clip is adapted to break in preference to the lid and the drum body when the seal between the lid and the drum body is first compromised;

wherein the clip includes a tail portion for contacting camming surfaces of a plurality of projections formed on an outer portion of an intermediate side wall portion of the drum body as the lid is being rotatably threaded onto the drum body, wherein the camming surfaces are adapted to lift the tail portion of the clip over the plurality of projections as the lid is rotatably threaded onto the drum body, and wherein the plurality of projections each further comprises a blocking surface for contacting the tail portion of the clip and thereby inhibiting unthreading of the lid from the drum body.

2. An overpack salvage drum comprising:

a drum body for holding a package to be overpacked;

a lid adapted to be rotatably threaded onto the drum body to seal the package held in the drum body therein; and a clip adapted to be operatively associated with the lid before the lid is rotatably threaded onto the drum body, wherein the clip is adapted to break in preference to the lid and the drum body when the seal between the lid and the drum body is first compromised;

wherein the clip includes a tail portion that is adapted to contact a camming surface of a projection formed on outer portion of an intermediate side wall portion of the drum body as the lid is being rotatably threaded onto the drum body, wherein the camming surface is adapted to lift the tail portion of the clip over the projection as the lid is rotatably threaded onto the drum body, wherein the projection further comprises a blocking surface adapted to contact the tail portion of the clip and thereby inhibit unthreading of the lid from the drum body, and wherein the clip further comprises a head portion, a hook portion and a body portion that spans between the head portion and the hook portion, the head portion including an upper tip end adapted to be received in an top recess formed in a top side of the lid, and the hook portion including a lower tip end adapted to be received in a bottom recess formed in an interior side of an annular skirt depending from the lid.

3. The overpack salvage drum according to claim 2 wherein the clip is received within a recessed area formed in the annular skirt such that sides of the recessed area provide lateral support for the clip when the clip is operatively associated with the lid.

4. The overpack salvage drum according to claim 1 wherein the drum body includes a bottom wall provided with a channel for receiving a beam.

5. The overpack salvage drum according to claim 1 wherein the clip is adapted to be fastened to the lid using a fastener before the lid is threaded onto the drum body.

6. An overpack salvage drum comprising:

a drum body for holding a package to be overpacked;

a lid adapted to be rotatably threaded onto the drum body to seal the package held in the drum body therein; and a clip adapted to be operatively associated with the lid before the lid is rotatably threaded onto the drum body, wherein the clip is adapted to break in preference to the lid and the drum body when the seal between the lid and the drum body is first compromised;

wherein the clip includes a tail portion that is adapted to contact a camming surface of a projection formed on outer portion of an intermediate side wall portion of the drum body as the lid is being rotatably threaded onto the drum body, wherein the camming surface is adapted to lift the tail portion of the clip over the projection as the lid is rotatably threaded onto the drum body, wherein the projection further comprises a blocking surface adapted to contact the tail portion of the clip and thereby inhibit unthreading of the lid from the drum body, wherein the clip is adapted to be fastened to the lid using a fastener before the lid is threaded onto the drum body, wherein the fastener is a threaded fastener, and wherein threads of the fastener are adapted to be received in an insert disposed in the lid.

7. The overpack salvage drum according to claim 2 wherein the drum body includes a bottom wall provided with a channel for receiving a beam.

8. The overpack salvage drum according to claim 2 wherein the clip is adapted to be fastened to the lid using a fastener before the lid is threaded onto the drum body.

9. The overpack salvage drum according to claim 6 wherein the drum body includes a bottom wall provided with a channel for receiving a beam.

10. The overpack salvage drum according to claim 6 wherein the clip is adapted to be fastened to the lid using a fastener before the lid is threaded onto the drum body.

* * * * *